United States Patent [19]

Frankel

[11] 4,282,683

[45] Aug. 11, 1981

[54] FLORAL ARRANGEMENT CONTAINERS

[76] Inventor: Bernard Frankel, 7957 Heather Rd., Elkins Park, Pa. 19117

[21] Appl. No.: 86,015

[22] Filed: Oct. 17, 1979

[51] Int. Cl.[3] ..... A47G 7/07

[52] U.S. Cl. ..... 47/41 R; 47/41.12

[58] Field of Search ..... 47/67, 41, 41.11, 41.12, 47/41.13

[56] References Cited

U.S. PATENT DOCUMENTS

| | | | |
|---|---|---|---|
| D. 250,376 | 11/1978 | Schoenbrun | 47/67 X |
| 1,515,787 | 11/1924 | Nishiyama et al. | 47/41 X |
| 2,818,681 | 1/1958 | Coplen | 47/41.11 X |
| 2,900,760 | 8/1959 | Tupper | 47/41.11 |
| 2,984,045 | 5/1961 | Eggan | 47/41.12 |
| 3,170,875 | 2/1965 | Swett | 47/41.11 X |
| 3,524,280 | 8/1970 | McKinnon | 47/41.11 |
| 3,651,601 | 3/1972 | La Montagne | 47/41.12 |
| 3,812,617 | 5/1974 | Brody | 47/41.11 X |
| 4,004,367 | 1/1977 | O'Connell | 47/41.12 |
| 4,044,502 | 8/1977 | Hillenbrand | 47/41.12 |

*Primary Examiner*—Robert E. Bagwill

*Attorney, Agent, or Firm*—Steele, Gould & Fried

[57] ABSTRACT

An open-topped container for holding floral arrangements or the like, utilizing a charge of mounting material disposed in the container, comprising attachment means formed integrally with the container, disposed around the top thereof and elastic securing means passing over the mounting material and held by the attachment means. In one embodiment, the attachment means are formed integrally with the body of the container, and in another embodiment, the attachment means are formed integrally with a rim at the top of the container. Attachment means formed integrally with the rim of the container may comprise either a plurality of members projecting downwardly from the rim or a plurality of notches formed in the rim. The container is further provided with a handle member, the ends of which are adapted for engaging the attachment means.

10 Claims, 7 Drawing Figures

FLORAL ARRANGEMENT CONTAINERS

BACKGROUND OF THE INVENTION

1. Field of the Invention

This invention relates to the field of containers for floral arrangements or the like, in general, and in particular, to a container having means for securing a charge of mounting material in the container.

2. Prior Art

In the art of floral arrangement several problems have been encountered over the years in facilitating the construction of floral arrangements. This is particularly so in the funeral trade, where very large quantities of floral arrangements must be provided on short notice. Floral arrangements do not normally consist of living plants, but primarily of cut flowers and foliage. The individual flowers and foliage, such as leaf branches, are mounted in materials such as shredded styrofoam, brick or shredded foam, vermiculite and greens, which are themselves disposed in a container. As flowers and the like are placed into the mounting material, there is a tendency for the material to shift or fall, increasing the time necessary to create the floral arrangement. More significant problems are incurred when shipping or delivering the floral arrangements, and it is necessary to be sure that the mounting material, and the flowers inserted therein, do not fall out of the containers. During the last 50 years or so, the most prevalent practice has been to utilize paper mache containers for holding the charge of mounting material, and to secure the mounting material in the containers by the use of adhesive tape strips. The most significant problem with the use of paper mache containers and adhesive tape is that the mounting material must be soaked with water in order for the flowers to maintain a fresh appearance. In only short periods of time the water soaks through the paper mache and the adhesive tape, rendering the containers difficult to handle at best and useless at worst.

It has been suggested in U.S. Pat. No. 2,818,681—Coplen to provide a container for living potted plants, the container being constructed from metal, and having a downwardly folded upper rim, from which mounting tabs are cut. The root ball is placed in the container, and a long cord is laced back and forth over the root ball and under the tabs, making perhaps a dozen passes over the root ball before being tied. Such a construction is unduly massive for floral arrangement, is excessively expensive, requires an inordinate amount of time to secure the root ball in the container and is quite unsightly. Further, this patent apparently recognizes a need to provide an outwardly extending bead which abuts the inner surface of the tabs, apparently in an effort to lock the cord in under the tab.

It has been suggested in U.S. Pat. No. 620,150—Kitchen to provide a receptacle for live orchids, comprising a pot constructed of many wood members and having a number of nails with large heads partially driven into the sides of the receptacle, near its bottom. The nails are used in conjunction with cord or wire to tie the plant down. This patent apparently recognizes the danger posed by the protruding nails, and illustrates the receptacle itself inserted into a large container. Further, no means are provided for securing the smaller receptacle in the larger container. Such a two tier system, constructed from expensive material, and requiring significant costs for construction is not at all suitable for the purposes of this invention.

In a significant departure both from the paper mache containers and adhesive tape used for floral arrangements, and from the rather awkward arrangement of the Coplen patent for live plants held in root balls, this invention provides a container for floral arrangements or the like, wherein the flowers are disposed in a charge of mounting material in the container, which overcomes all of the disadvantages of the two practices noted above. A plastic container is provided in which attachment means are formed integrally with the container, disposed around the top of the container. An elastic securing means, such as rubber bands or the like, is passed over the mounting material and held by the attachment means. The attachment means may be members projecting directly from the body of the container, may be members projecting downwardly from a rim at the top of the container, or may be notches formed in a rim disposed at the top of the container. In either event, a charge of mounting material may be permanently but releaseably secured in such a container in a matter of seconds. Further, such an arrangement is impervious to the affects of the water. Of course, floral arrangements are used for many purposes other than funerals, and for this reason, there is also provided a decorative, but functional handle for such a container, the ends of the handle being adapted for engaging the particular attachment means formed with the container.

SUMMARY OF THE INVENTION

It is an object of this invention to provide a container for holding floral arrangements or the like, utilizing a charge of mounting material disposed in the container.

It is another object of this invention to provide a container for holding floral arrangements or the like, utilizing a charge of mounting material disposed in the container, having means for securing the mounting material.

It is still another object of this invention to provide a container for holding floral arrangements or the like, utilizing a charge of mounting material disposed in the container, having means for permanently but releaseably securing the mounting material in the container.

It is yet another object of this invention to provide a container for holding floral arrangements or the like, utilizing a charge of mounting material disposed in the container, having attachment means formed integrally with the container, disposed around the top thereof, and elastic securing means passing over the mounting material and held by the attachment means.

It is yet a further object of this invention to provide a handle for a container for holding floral arrangements or the like, utilizing a charge of mounting material disposed in the container, and having attachment means form integrally with the container, the handle member having ends adapted for engaging the attachment means.

These and other objects of this invention are accomplished by providing an open-top container for holding floral arrangements or the like, utilizing a charge of mounting material disposed in the container, comprising attachment means formed integrally with the container, disposed around the top thereof, and elastic securing means passing over the mounting material and held by the attachment means. The attachment means can be formed integrally with the side of the container, or integrally with a rim formed at the top of the container. In the embodiment where the attachment means are formed integrally with the rim, the attachment means may comprise either a plurality of members projecting downwardly from the rim or a plurality of notches formed in the rim. In any embodiment, the invention further comprises a handle member for the container, having ends adapted for engaging the attachment means.

BRIEF DESCRIPTION OF THE DRAWINGS

For the purpose of illustrating the invention, there are shown in the drawings forms which are presently preferred; it being understood, however, that this invention is not limited to the precise arrangements and instrumentality shown.

DETAILED DESCRIPTION OF THE PREFERRED EMBODIMENTS

Figure 1:
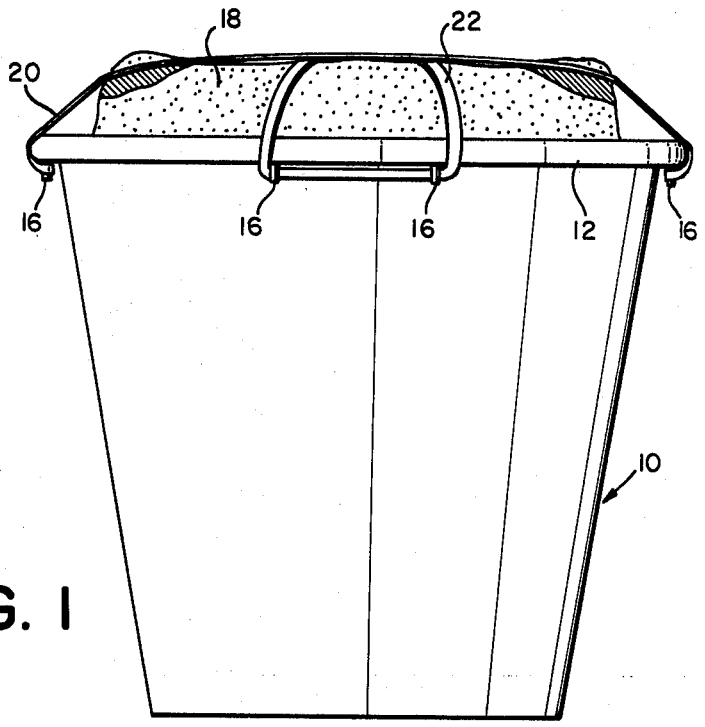
FIG. 1 is a side elevation of a container according to this invention.
Figure 2:
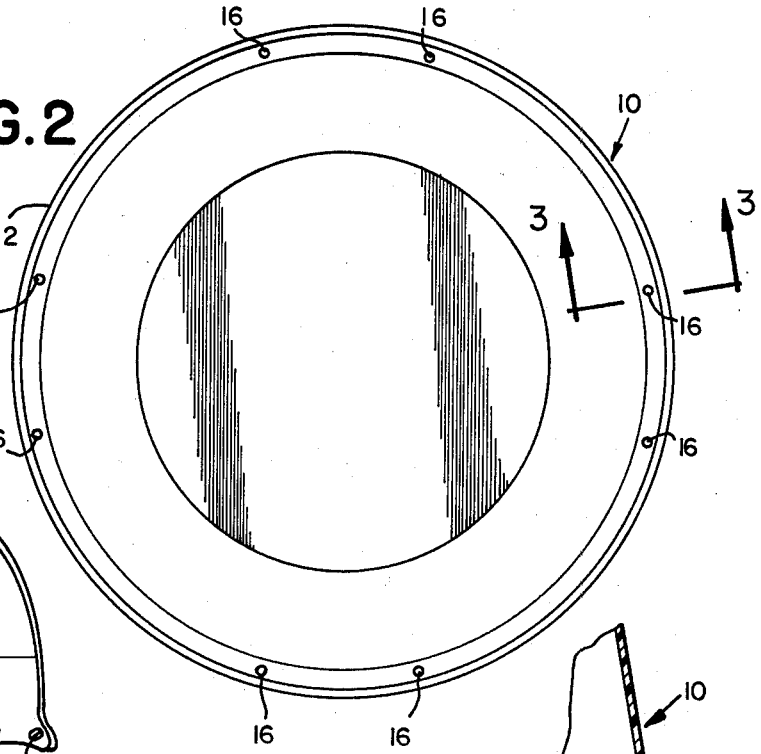
FIG. 2 is a bottom view of the container shown in FIG. 1.
Figure 3:
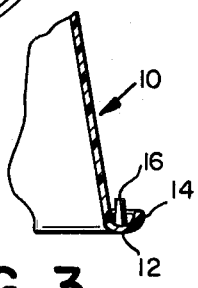
FIG. 3 is a section view taken along the line 3—3 in FIG. 2.

An open-top container 10 for holding floral arrangements or the like, utilizing a charge of mounting material 18 disposed in the container is shown in FIG. 1. The container 10, which is preferably made from molded plastic material, is in the general form of a flower pot. A typical container might be approximately 7" high, have an upper diameter of approximately 8" and a lower diameter of approximately 5½". The container 10 is provided with an outwardly extending rim 12. A plurality of members 16 project downwardly from the rim 12. The length of the members 16 is preferably approximately 3/16" to ¼". A suitable spacing for the members 16 is illustrated in FIG. 2. The arrangement shown in FIGS. 1 and 2 permits the charge of mounting material 18, which may be a brick of foam as shown, to be secured by elastic securing means, such as two rubber bands 20 and 22, passing over the mounting material and being held by the attachment means formed by members 16. The mounting material 18 may also be shredded foam, vermiculite or greens. As shown in FIG. 3, the lip of the rim 12 may be provided with a rounded bead portion 14 for safety and decorative purposes.

Such a container 10 greatly facilitates the creation of a floral arrangement. In a matter of seconds, a block of mounting material 18 may be placed inside a container 10, and retained permanently but releaseably therein by the elastic securing means. The container can then be filled with enough water to soak the mounting material. The mounting means is completely impervious to water damage. As shown in FIG. 1, such elastic securing means will in most cases dig into the block or charge of mounting material, and therefor be substantially not visible. This will of course be particularly true when the flowers and the like have been inserted into the mounting material.

In the field of floral displays for funerals and similar applications, this invention provides a means for greatly facilitating the construction of large numbers of floral arrangements, which are virtually damage proof, as compared to floral arrangements made and shipped in the standard paper mache container.

Figure 4:
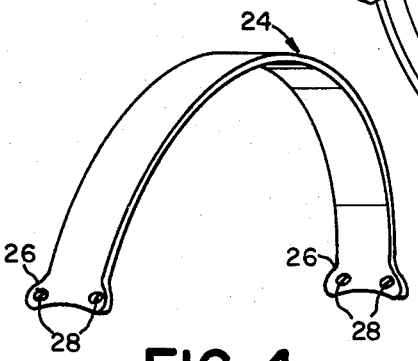
FIG. 4 is a handle suitable for use with the attachment means illustrated in the embodiment of FIGS. 1–3.

Of course, floral arrangements have many uses other than for funerals, and it is often desirable to make the containers appear more decorative. To this end, containers for floral arrangements are often provided with handles. The container described herein is particularly suitable for use with a decorative handle, and such a handle 24 is shown in FIG. 4. The handle 24 has two ends 26, each of which has two holes or apertures 28. The shapes of ends 26 are adapted so that holes or apertures 28 can engage a set of projecting members 16, and thereby be easily connected to the container. The connection is sufficiently strong and geometrically oriented so that the container 10 can be carried by the handle 24 as well. Further, use of the handle will not interfere with the elastic securing means, as the handle can be easily fitted thereover, provided the projecting member 16 are long enough.

Figure 5:
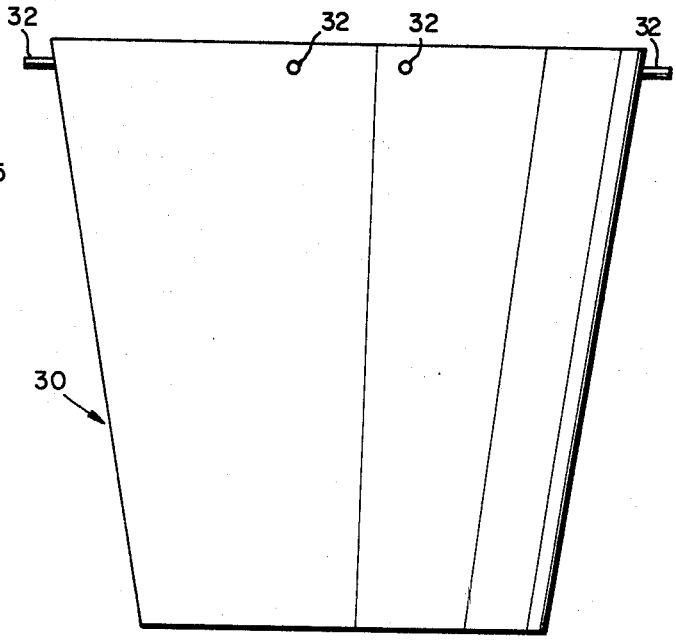
FIG. 5 is a side elevation of an alternative embodiment of a container according to this invention.

An alternative embodiment of a container according to this invention is the container 30 shown in FIG. 5. Container 30 is not provided with a rim, as the embodiment of FIGS. 1–3, but is instead provided with outwardly projecting members 32, formed integrally with the side wall of the container. Members 32 perform in a fashion identical to projecting members 16, with regard to the attachment of elastic securing means and with regard to the use of handle 24. The projecting members 32 may extend out horizontally from the container, as shown, or may extend perpendicularly from the side walls of the container. In this instance, members 32 would be projecting slightly downward from horizontal.

Figure 6:
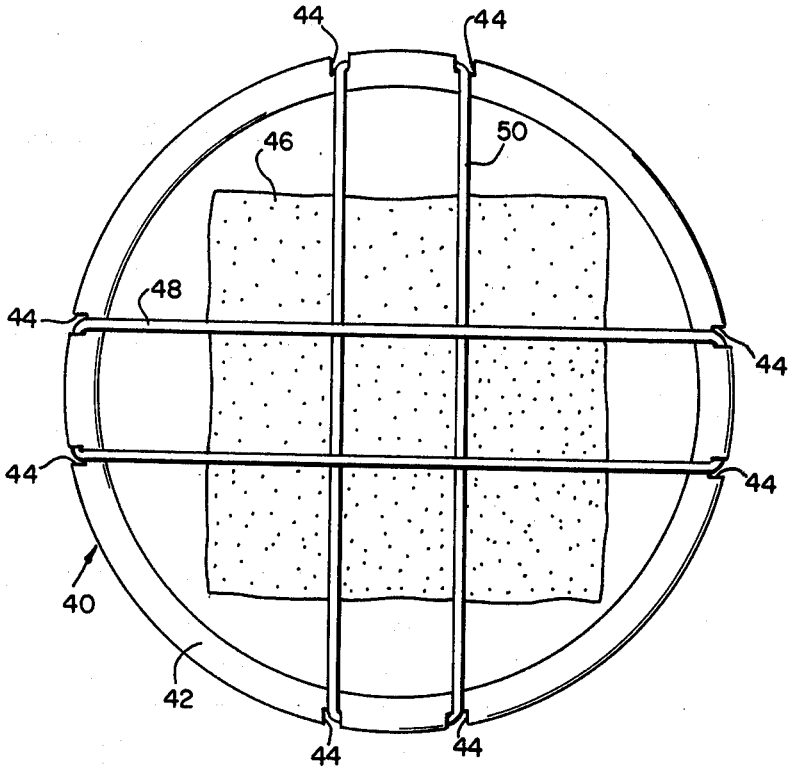
FIG. 6 is a top view of still another embodiment of a container in accordance with this invention; and, FIG. 7 is a handle suitable for use with the embodiment illustrated in FIG. 6.
Figure 7:
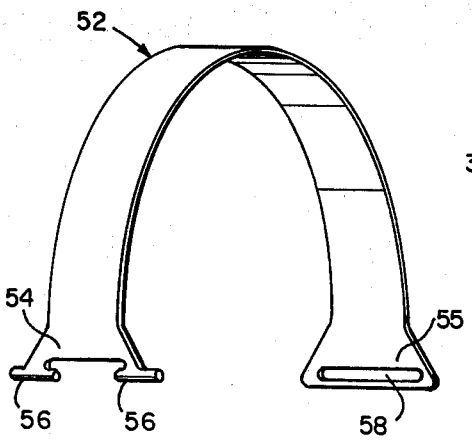

A third embodiment of a container according to this invention is the container 40, shown in FIG. 6. Container 40 is provided with an outwardly extending rim 42, at the top of the container. If desired, the rim may have a configuration or cross section similar to that shown in FIG. 3. In the embodiment shown in FIG. 6, rim 42 is provided with a plurality of notches 44. Elastic securing means in the form of rubber bands 48 and 50 permanently but releaseably secure a charge of mounting material 46 in container 40. FIG. 7 shows a handle 52 suitable for use with the container shown in FIG. 6. The handle 52 has ends 54 and 55, each of which illustrates an alternative means for attaching the handle to the container. End 54 is provided with two substantially T-shaped projecting members 56, each of which can be slipped into an adjacent pair of notches 44. End 55 is provided with an elongated slot 58, which can be slipped over that portion of the rim 42 between adjacent notches 44.

In each of the embodiments described herein, the container is preferably molded from plastic material, and the attachment means are preferably formed or molded integrally with the container, although the container need not necessarily be manufactured in this fashion. Further, although rubber bands are illustrated in depicting the elastic securing means, it will be appreciated that other elastic securing means may be utilized. If elastic securing means are unavailable, it would still be possible to utilize cord, wire, twine or the like in place of the elastic securing means.

The present invention may be embodied in other specific forms without departing from the spirit or essential attributes thereof, and accordingly, reference should be made to the appended claims, rather than to the foregoing specification as indicating the scope of the invention.

I claim:

1. A flower pot for holding arrangements of cut flowers or the like, utilizing a charge of mounting material disposed in the flower pot, comprising:

an open-top container having an upstanding side wall;

a rim extending outwardly from the top of the side wall;

attachment means formed integrally with the rim and projecting downwardly from the underside of the rim;

elastic securing means passing over the mounting material and locking the material in place within said pot, being held by the attachment means; and, a handle, having ends adapted for engaging the attachment means and overfitting the securing means, positively preventing separation of the securing means from the attachment means.

2. The flower pot of claim 1, wherein the attachment means comprises a plurality of projecting members distributed around the rim.

3. The flower pot of claim 2, wherein the projecting members are disposed in pairs, each pair being opposite another pair.

4. A flower pot for holding arrangements of cut flowers or the like, utilizing a charge of mounting material disposed in the flower pot, comprising:

an open-top container having an upstanding side wall;

a rim extending outwardly from the top of the side wall, a plurality of outwardly opening radial notches formed in the rim, the notches being disposed in pairs of adjacent notches;

elastic securing means passing over the mounting material and locking the material in place within said pot, being held by portions of the rim between the pairs of notches; and, a handle, having ends adapted for engaging the notches and the rim portions therebetween and overfitting the securing means, positively preventing separation of the securing means from the attachment means.

5. The flower pot of claim 1 or 4, wherein the container is molded from plastic material, and the attachment means are molded integrally therewith.

6. A flower pot for holding arrangements of cut flowers or the like, utilizing a charge of mounting material disposed in the flower pot, comprising:

an open-top container having an upstanding side wall;

a rim formed integrally with the side wall, extending outwardly from the top of the side wall;

a rounded bead formed integrally with the rim, depending downwardly from the outer edge of the rim, and defining a downwardly opening channel between the bead, the rim and the side wall;

attachment means formed integrally with the rim, disposed in the channel and projecting downwardly beyond the rounded bead, the rounded bead and the rim, in use, substantially shielding the attachment means from view; and, elastic securing means passing over the mounting means, tending to become embedded within the mounting material and locking the material in place within the container, the elastic securing means being held in place by the projecting means and being guided smoothly over the rim by the rounded bead, being thereby protected from abrasive and cutting contacts, portions of the elastic securing means adjacent the attachment means also being substantially shielded from view.

7. The flower pot of claim 6, further comprising a handle, having ends adapted for engaging the attachment means.

8. The flower pot of claim 6, wherein the attachment means are approximately twice as long as the channel is deep.

9. The flower pot of claim 6 or 8, wherein the attachment means are pins.

10. The flower pot of claim 9, wherein the pins are disposed in pairs.

* * * * *